US008166609B2

(12) United States Patent
Cha et al.

(10) Patent No.: US 8,166,609 B2
(45) Date of Patent: May 1, 2012

(54) SUCTION NOZZLE AND VACUUM CLEANER HAVING THE SAME

(75) Inventors: Seung-Yong Cha, Gwangju (KR); Jang-Keun Oh, Seo-Gu (KR)

(73) Assignee: Samsung Electronics Co., Ltd., Gwangju (KR)

( * ) Notice: Subject to any disclaimer, the term of this patent is extended or adjusted under 35 U.S.C. 154(b) by 971 days.

(21) Appl. No.: 12/167,388

(22) Filed: Jul. 3, 2008

(65) Prior Publication Data

US 2009/0188074 A1 Jul. 30, 2009

(30) Foreign Application Priority Data

Jan. 29, 2008 (KR) ..... 10-2008-0009224

(51) Int. Cl.
*A47L 9/04* (2006.01)

(52) U.S. Cl. ..... 15/383; 15/339; 15/403

(58) Field of Classification Search ..... 15/339, 15/383, 403; *A47L 9/04, 9/06*
See application file for complete search history.

(56) References Cited

U.S. PATENT DOCUMENTS 4,319,379 A 3/1982 Carrigan et al.

FOREIGN PATENT DOCUMENTS

| | | |
|---|---|---|
| JP | 09-192070 | 7/1997 |
| JP | 2001169979 | 6/2001 |
| JP | 20033019093 | 1/2003 |
| JP | 2005028183 | 2/2005 |
| KR | 10-2007-0030316 | 3/2007 |

*Primary Examiner* — David Redding
(74) *Attorney, Agent, or Firm* — Blank Rome LLP

(57) ABSTRACT

A suction nozzle of a vacuum cleaner includes a suction nozzle body which includes a suction port adapted to draw in contaminants on a surface, and a contaminant attachment unit formed in the suction nozzle body. The contaminant attachment unit is adapted to attach contaminants thereto.

17 Claims, 5 Drawing Sheets

SUCTION NOZZLE AND VACUUM CLEANER HAVING THE SAME

CROSS-REFERENCE TO RELATED APPLICATION

This application claims the benefit under 35 U.S.C. §119 of Korean Patent Application No. 10-2008-9224, filed on Jan. 29, 2008, in the Korean Intellectual Property Office, the entire disclosure of which is incorporated herein by reference.

FIELD OF THE INVENTION

The present invention relates to a vacuum cleaner. More particularly, the present invention relates to a suction nozzle of a vacuum cleaner having improved efficiency of collecting contaminants on a surface.

BACKGROUND OF THE INVENTION

In general, vacuum cleaners draw in air containing dust and contaminants from a surface and collect the dust and contaminants in a dust collecting apparatus. A user may select one of a range of suction nozzles according to the type of surface.

Fibrous surfaces, such as carpets, typically need to be blown or swept using blowers, such as agitators. Unless such blowers are provided on suction nozzles, it is difficult to remove some contaminants, such as human or animal hair, or waste threads, and the like from carpets.

Blowers, however, require a separate driving unit for operation, which can increase the costs of manufacturing the suction nozzles. In addition, noise caused by operation of the blower during cleaning may also increase, and the carpet may be worn down due to friction with the blower.

Furthermore, if the surface to be cleaned is sticky, human or animal hair attached to the surface may not be drawn into the suction nozzle by a suction force of a vacuum motor. As a result, the user must clean the surface again in order to remove the remaining contaminants.

SUMMARY OF THE INVENTION

Accordingly, to solve at least the above problems and/or disadvantages and to provide at least the advantages described below, a non-limiting object of the present invention is to provide a suction nozzle that can be manufactured cost-effectively and have an improved structure to conveniently collect thin and long contaminants such as hair or waste threads, without generating additional noise.

According to another exemplary aspect of the present invention, there is provided a suction nozzle of a vacuum cleaner including a suction nozzle body having a suction port adapted to draw in contaminants on a surface, and a contaminant attachment unit formed in the suction nozzle body. The contaminant attachment unit is adapted to attach contaminants thereto.

The contaminant attachment unit may be located behind the suction port, and include a tape roller, a roller axis supporting the tape roller, and an elastic support unit elastically supporting the roller axis.

According to another exemplary aspect of the present invention, there is provided a vacuum cleaner including a cleaner body and a suction nozzle connected to the cleaner body. The suction nozzle includes a suction nozzle body having a suction port adapted to draw in contaminants on a surface, and a contaminant attachment unit formed in the suction nozzle body. The contaminant attachment unit is adapted to attach contaminants thereto.

BRIEF DESCRIPTION OF THE DRAWINGS

The above and/or other aspects of the present invention will be more apparent by describing certain exemplary embodiments of the present invention with reference to the accompanying drawings, in which.

DETAILED DESCRIPTION OF EXEMPLARY EMBODIMENTS OF THE INVENTION

Figure 1:
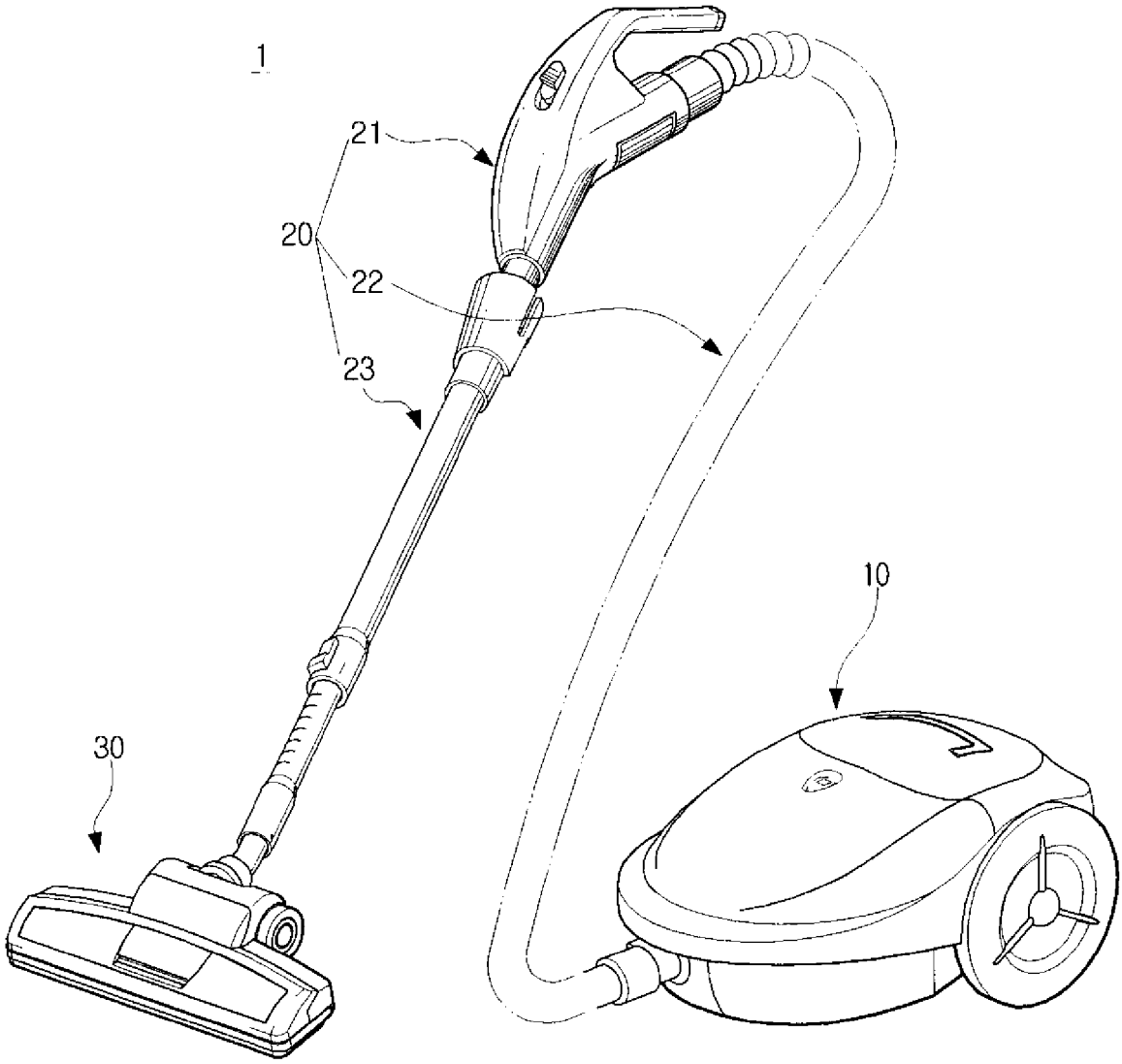
FIG. 1 is a perspective view illustrating a vacuum cleaner having a suction nozzle according to an exemplary embodiment of the present invention.

Certain exemplary embodiments of the present invention will now be described in greater detail with reference to the accompanying drawings.

In the following description, like drawing reference numerals are used for like elements. The matters defined in the description, such as the detailed construction and elements, are provided to assist in a comprehensive understanding of the invention. However, the present invention can be practiced without those specifically defined matters. Also, well-known functions or constructions are not described in detail since they would obscure the invention with unnecessary detail.

FIG. 1 illustrates a vacuum cleaner having a vacuum cleaner 1 according to an exemplary embodiment of the present invention. The vacuum cleaner includes a cleaner body 10, an air path forming member 20 connected to the cleaner body 10, and a suction nozzle 30 connected to the air path forming member 20.

The cleaner body 10 may include a dust collecting apparatus (not shown) and a suction motor (not shown). The cleaner body 10 draws contaminants from a surface using a suction force generated by the suction motor, and collects the contaminants in the dust collecting apparatus.

The air path forming member 20 may include a handle 21 which is gripped by a user, a flexible hose 22 which is connected to the cleaner body 10, and an extension pipe 23, one end of which is connected to the handle 21 and the other end is connected to the suction nozzle 30.

Figure 2:
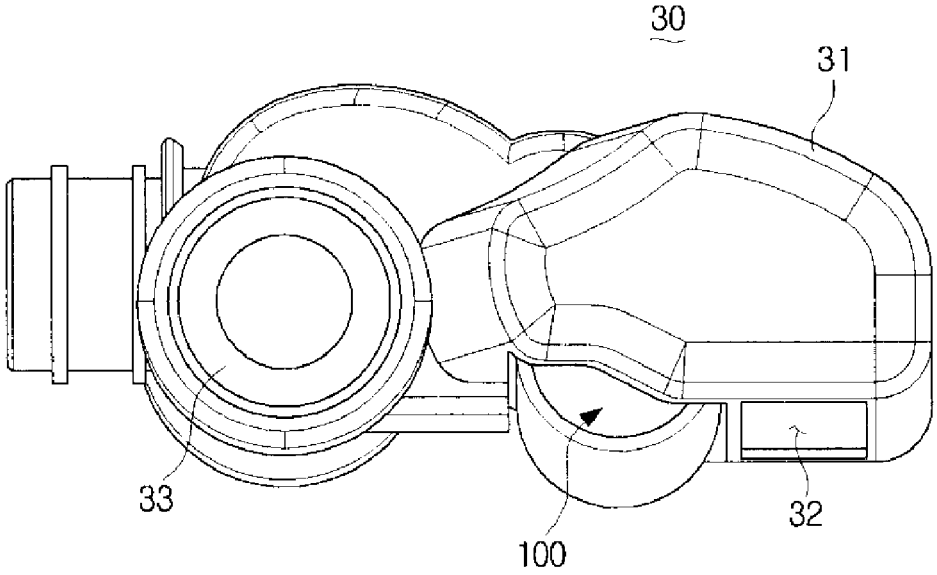
FIG. 2 is a side elevational view of a suction nozzle according to an exemplary embodiment of the present invention.

The suction nozzle 30 may include a suction nozzle body 31 and a contaminant attachment unit 100 as shown in FIG. 2. The suction nozzle body 31 includes a suction port 32 which faces the surface being cleaned, and a plurality of wheels 33 which smoothly travel over the surface.

As shown in FIG. 2, the contaminant attachment unit 100 is formed behind the suction port 32. When the user pushes the suction nozzle 30 to clean the surface, contaminants on the surface are first drawn in through the suction port 32, and any contaminants remaining on the surface attach to the contaminant attachment unit 100. Preferably, the contaminant attachment unit 100 is located behind the suction port 32. Alternatively, the contaminant attachment unit 100 may be located in front of the suction port 32.

Figure 3:
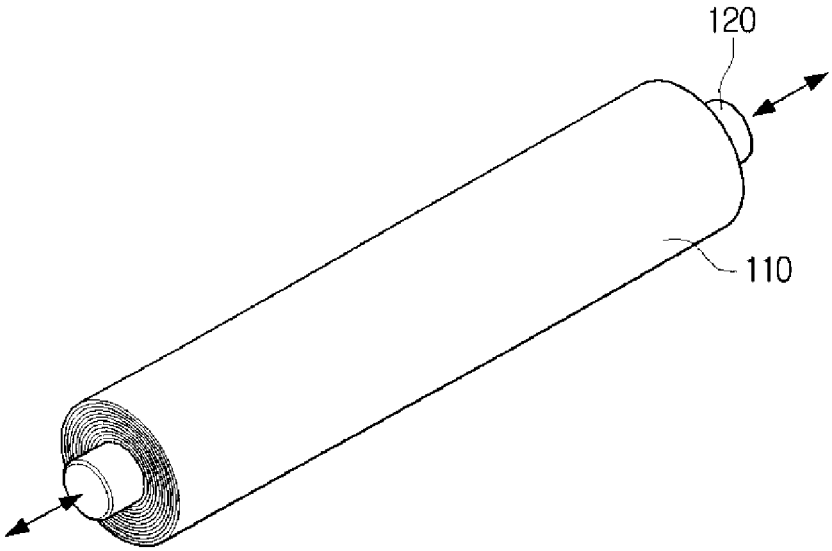
FIGS. 3 and 4 are perspective views illustrating a tape roller mounted in the suction nozzle of FIG. 2.
Figure 4:
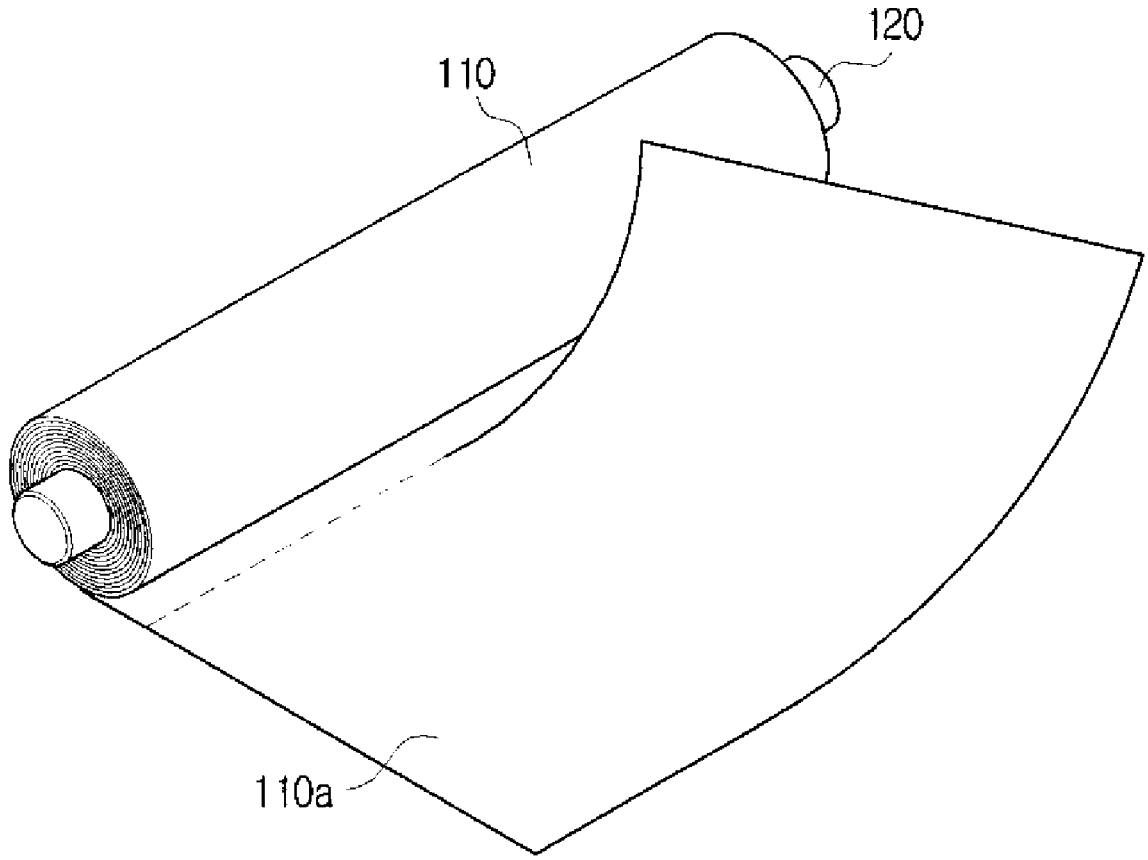

The contaminant attachment unit 100 may include a tape roller 110, a roller axis 120 and an elastic support unit 130. The roller axis 120 supports the tape roller 110, and may be extended or contracted axially along the arrows as shown in FIG. 3. As shown in FIGS. 3 and 4, the tape roller 110 includes sheets of tapes 110*a* which are connected to each other so as to be torn off in lengths equivalent to the circumference of the tape roller 110. Therefore, when hair or dust is sufficiently attached to a sheet of tape 110*a* on the tape roller 110 such that the sheet of tape 110*a* is no longer sticky, the sheet of tape 110*a* is torn off and dumped and a new sheet of tape 110*a* is used.

Any prior art methods for extending and contracting a pole may be applied for the roller axis 120. For example, the roller axis 120 may include a first cylindrical unit (not shown) and a second cylindrical unit (not shown) which can be inserted into the first cylindrical unit. A spring is formed between the first and second cylindrical units. Accordingly, if the user presses the first cylindrical unit and/or the second cylindrical unit, the roller axis 120 is shortened, and if the user releases the pressure, the roller axis 120 is restored to its former state. Since such a structure is widely used for toilet roll holders, detailed description is omitted here. In another method, both ends of the roller axis 120 which protrude from the tape roller 110 may be contracted at the same time to insert the tape roller 110 into the suction nozzle body 31.

The roller axis 120 supports the tape roller 110 on the suction nozzle body 31. The roller axis 120 may be made of a flexible material such as extendable hard rubber. In addition, parts of the suction nozzle body 31, into which the roller axis 120 is inserted, may be made of a flexible material.

Figure 5:
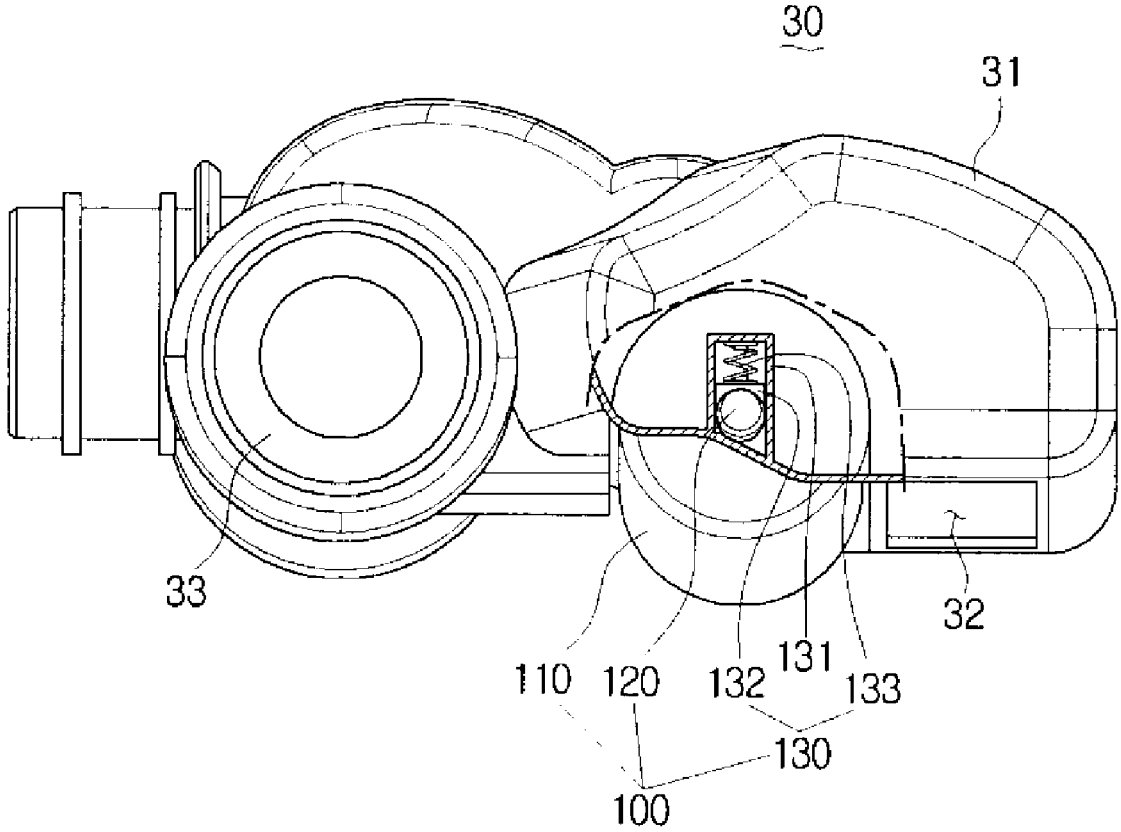
FIG. 5 is a side perspective view in partial section illustrating a structure to support a tape roller of a suction nozzle according to an exemplary embodiment of the present invention.

As shown in FIG. 5, the elastic support unit 130 elastically supports the roller axis 120 with respect to the surface to be cleaned, so that the tape roller 110 is always in close contact with the surface during cleaning. The elastic support unit 130 may include a guide slit 131, a support member 132 and an elastic member 133. The elastic support unit 130 preferably supports both ends of the roller axis 120. The guide slit 131 is formed in the suction nozzle body 31 and vertically guides the roller axis 120. The support member 132 may vertically move with the roller axis 120 in the guide slit 131. One end of the support member 132 supports the roller axis 120, and the other end is pressed by the elastic member 133.

The end of the support member 132 supporting the roller axis 120 may be formed in a circular arc shape having the same diameter as the roller axis 120, and so the curved edge may contact the roller axis 120. Alternatively, the end of the support member 132 may have a flat surface which contacts the roller axis 120. A lubricant may be applied between the support member 132 and the roller axis 120 to minimize abrasion caused by friction at the point of contact.

The elastic member 133 may be inserted between the guide slit 131 and the support member 132. The elastic member 133 presses the support member 132 onto the roller axis 120 such that the tape roller 110 can stay in contact with the surface being cleaned.

Figure 6:
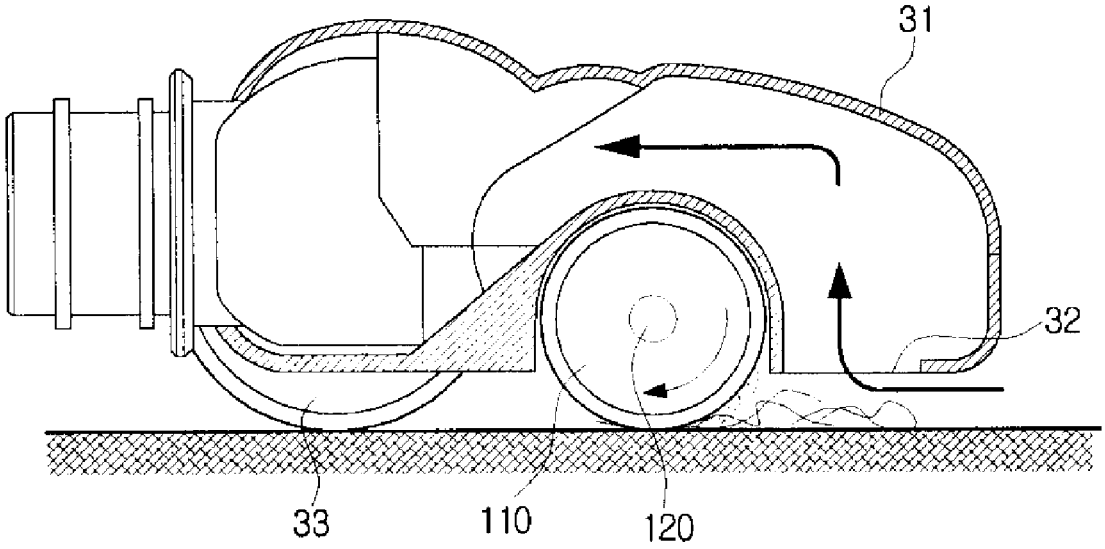
FIG. 6 is a side elevational view in partial section illustrating an operational state of a suction nozzle according to an exemplary embodiment of the present invention.

The cleaning operation of the suction nozzle 30 according to an exemplary embodiment of the present invention is now described with reference to FIG. 6. During operation, the user may place the suction nozzle 30 in contact with a surface. The suction nozzle 30 collects contaminants on the surface by a forward and backward movement. As shown in FIG. 6, when the user pushes the suction nozzle 30 forward, contaminants are drawn in through the suction port 32 by a suction force generated by the suction motor in the cleaner body 10 (see FIG. 1). The contaminant attachment unit 100 behind the suction port 32 may then remove any contaminants remaining on the surface such as hair, waste threads or dust.

According to the exemplary embodiment of the present invention, the contaminant attachment unit 100 may include the rotatable tape roller 110 which can easily remove hair or fine dust from a sticky surface or carpet. Because the contaminant attachment unit 100 using the tape roller 110 has a simple structure, the manufacturing costs are lower than a blower or agitator with a drive unit. Moreover, because the tape roller 110 can pick up most or all of the remaining contaminants, the user does not face the inconvenience of cleaning the remaining contaminants again.

The foregoing exemplary embodiments are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A suction nozzle of a vacuum cleaner, comprising:
a suction nozzle body including,
a suction port adapted to draw in contaminants on a surface; and
a contaminant attachment unit detachably formed in the suction nozzle body, the contaminant attachment unit adapted to attach contaminants thereto, wherein the contaminant attachment unit is located behind the suction port, and wherein the contaminant attachment unit comprises:
a tape roller including a roll of tapes on which a bonding agent is applied;
a roller axis for supporting the tape roller; and
an elastic support unit for elastically supporting the roller axis.

2. The suction nozzle of claim 1, wherein the roll of tapes includes sheets of tapes which are connected to each other in order to be torn off in lengths equivalent to a circumference of the tape roller.

3. The suction nozzle of claim 1, wherein the elastic support unit comprises:
a guide slit formed in the suction nozzle body to provide a vertical guide for the roller axis;
a support member for supporting the roller axis; and
an elastic member coupled between the guide slit and the support member for elastically pressing the support member onto the roller axis.

4. The suction nozzle of claim 3, wherein the roller axis is adapted to extend and contract in an axial direction.

5. The suction nozzle of claim 1, wherein the suction nozzle body further comprises a plurality of wheels located behind the contaminant attachment unit.

6. A suction nozzle of a vacuum cleaner, comprising:
a suction nozzle body including,
a suction port adapted to draw in contaminants on a surface; and
a contaminant attachment unit detachably formed in the suction nozzle body, wherein the contaminant attachment unit is a tape roller for attaching contaminants thereto.

7. A vacuum cleaner, comprising:
a cleaner body; and a suction nozzle connected to the cleaner body, the suction nozzle including a suction nozzle body having a suction port adapted to draw in contaminants on a surface; and a contaminant attachment unit detachably formed in the suction nozzle body, the contaminant attachment unit adapted to attach contaminants thereto, wherein the contaminant attachment unit is a tape roller.

8. The vacuum cleaner of claim 7, wherein the tape roller is located behind the suction port.

9. The vacuum cleaner of claim 8, wherein:

said tape roller including a roll of tapes on which a bonding agent is applied;

a roller axis for supporting the tape roller; and an elastic support unit for elastically supporting the roller axis.

10. The vacuum cleaner of claim 9, wherein the roll of tapes includes sheets of tapes which are connected to each other in order to be torn off in lengths equivalent to a circumference of the tape roller.

11. The vacuum cleaner of claim 10, wherein the elastic support unit comprises;

a guide slit formed in the suction nozzle body to provide a vertical guide for the roller axis;

a support member for supporting the roller axis; and an elastic member coupled between the guide slit and the support member for elastically pressing the support member onto the roller axis.

12. The vacuum cleaner of claim 11, wherein the roller axis is adapted to extend and contract in an axial direction.

13. The vacuum cleaner of claim 12, wherein the suction nozzle body further comprises a plurality of wheels located behind the contaminant attachment unit.

14. The vacuum cleaner of claim 11, wherein the support member has a curved surface.

15. The vacuum cleaner of claim 11, wherein the support member has a flat surface.

16. The vacuum cleaner of claim 3, wherein the support member has a curved surface.

17. The vacuum cleaner of claim 3, wherein the support member has a flat surface.

* * * * *